US009211464B2

(12) United States Patent
Francis

(10) Patent No.: US 9,211,464 B2
(45) Date of Patent: Dec. 15, 2015

(54) MARTIAL ARTS TRAINING DEVICES AND METHODS

(71) Applicant: Punch Chucks LLC, Chandler, AZ (US)

(72) Inventor: Mario Oscar Francis, Scottsdale, AZ (US)

(73) Assignee: Punch Chucks LLC, Chandler, AZ (US)

( * ) Notice: Subject to any disclaimer, the term of this patent is extended or adjusted under 35 U.S.C. 154(b) by 0 days.

(21) Appl. No.: 14/270,992

(22) Filed: May 6, 2014

(65) Prior Publication Data

US 2014/0336014 A1 Nov. 13, 2014

Related U.S. Application Data

(60) Provisional application No. 61/821,053, filed on May 8, 2013.

(51) Int. Cl.
*A63B 69/20* (2006.01)
*A63B 69/26* (2006.01)

(52) U.S. Cl.
CPC ..... *A63B 69/203* (2013.01); *A63B 69/26* (2013.01); *A63B 2209/10* (2013.01)

(58) Field of Classification Search
CPC ..... A63B 69/0086; A63B 69/004; A63B 2208/12; A63B 69/26; A63B 67/10; A63B 69/20; A63B 2220/53; A63B 43/02; A63B 69/0088; A63B 21/0004; A63B 21/0552; A63B 2244/10; A63B 2244/102; A63B 43/007; A63B 67/00; A63B 21/0557; A63B 71/081; A63B 2024/0046; A63B 67/002; A63B 69/203; A63B 69/24; A63C 19/005; G09B 19/0038; G09B 19/00; G09B 9/00
USPC ..... 482/88
See application file for complete search history.

(56) References Cited

U.S. PATENT DOCUMENTS

| | | | | | |
|---|---|---|---|---|---|
| 1,753,309 | A | * | 4/1930 | Costello | 482/88 |
| 1,851,433 | A | * | 3/1932 | Israel | 482/88 |
| 1,941,877 | A | * | 1/1934 | Brazeau | 482/88 |
| 1,945,440 | A | * | 1/1934 | Maslo | 482/88 |
| 2,186,016 | A | * | 1/1940 | Evans | 482/88 |
| 4,071,241 | A | * | 1/1978 | Cortes Garcia | 473/424 |
| 4,121,822 | A | * | 10/1978 | DiSabatino et al. | 482/88 |
| 4,121,829 | A | * | 10/1978 | Petrusek | 473/576 |
| 4,130,276 | A | * | 12/1978 | Tricarico | 482/88 |
| 4,756,527 | A | * | 7/1988 | Ledbetter | 482/139 |

(Continued)

OTHER PUBLICATIONS

Blaal (Youtube non-patent literature, https://youtu.be/Yg_7v5GD8Kg, "Coach O's 'Punch Chucks,'" published May 22, 2012).*

(Continued)

*Primary Examiner* — Loan H Thanh
*Assistant Examiner* — Andrew S Lo
(74) *Attorney, Agent, or Firm* — Snell & Wilmer L.L.P.

(57) ABSTRACT

A training system enables improved training outcomes and reduced trainer injuries. An exemplary system includes a handle, a striking target, and a flexible linkage coupling the handle and target. The system may be swung to provide an offensive or defensive target for a trainee. Because the trainee strikes the striking target rather than an item held in the hand of a trainer, impact to the body of the trainer is reduced and/or eliminated.

13 Claims, 7 Drawing Sheets

(56) References Cited

U.S. PATENT DOCUMENTS

| | | | | |
|---|---|---|---|---|
| 5,522,757 | A * | 6/1996 | Ostrowski | 446/220 |
| 5,681,168 | A * | 10/1997 | Brown | 434/219 |
| 5,735,776 | A * | 4/1998 | Swezey et al. | 482/91 |
| 7,794,374 | B1 * | 9/2010 | Park | 482/122 |
| 2001/0001094 | A1 * | 5/2001 | Panes | 482/93 |
| 2004/0219988 | A1 * | 11/2004 | Park et al. | 473/256 |
| 2004/0220022 | A1 * | 11/2004 | McCreath | 482/83 |
| 2006/0264300 | A1 * | 11/2006 | Chen | 482/14 |
| 2010/0210378 | A1 * | 8/2010 | Safran | 473/423 |
| 2012/0100966 | A1 * | 4/2012 | Chen | 482/83 |
| 2012/0289382 | A1 * | 11/2012 | Haddad et al. | 482/93 |
| 2013/0085045 | A1 * | 4/2013 | Chavez et al. | 482/93 |

OTHER PUBLICATIONS

Maldonado (Youtube non-patent literature, https://youtu.be/tA3JJMdxWgg, "Focus Mitts Drills—Boxing Pad Work—Training," published Apr. 23, 2010).*

* cited by examiner

MARTIAL ARTS TRAINING DEVICES AND METHODS

CROSS REFERENCE TO RELATED APPLICATIONS

This application claims priority to, and the benefit of, U.S. Provisional Application Ser. No. 61/821,053 entitled "MARTIAL ARTS TRAINING DEVICE AND METHODS" and filed May 8, 2013, which is incorporated herein by reference in its entirety.

TECHNICAL FIELD

The present disclosure relates to martial arts training, and in particular to a device for training in boxing, martial arts, mixed martial arts, or the like.

BACKGROUND

Current hand-held training devices, for example for boxing or martial arts, available on the market have created problems for trainers. For example, focus mitts and pads have to be held by hand, and the impact of blows causes stress and wear on the trainer's body, including the neck, shoulders, elbows, and wrists. Joint strain and repetitive stress injuries occur in professional and amateur trainers for boxing, martial arts, mixed martial arts (MMA), sports training, athletic training, and the like.

When it comes to devices and methods for martial arts training, for example boxing training, most trainers and instructors use focus mitts or other hand-held pads. Focus mitts and pads can cause harm to a trainer from the repeated blows. This is due to the nature of the training and the direct connection between the trainer, a normal mitt or pad, and the blow. Alternative methods of training include heavy bag, speed bag, uppercut bag, paddles, and strike pads. However, all of these alternatives either require the individual being trained to remain stationary, or require the trainer or coach to absorb a portion of the blow. Accordingly, improved devices and methods for martial arts training remain desirable.

SUMMARY

In an exemplary embodiment, a boxing training device comprises: a handle graspable by a trainer; a striking target configured for striking by a trainee; and a flexible cord coupling the handle and the striking target.

In another exemplary embodiment, a training device comprises: a handle having a grasping cord passing therethrough, the grasping cord configured to pass between the index finger and middle finger of a user when the handle is grasped; a ring coupled to the grasping cord and coupled to a bungee cord; a target loop coupled to the bungee cord, the bungee cord forming a loop and passing through the ring and the target loop; and a striking target coupled to the target loop.

In another exemplary embodiment, a method of training a boxer comprises: grasping, by a trainer, a handle of a boxing training device; and swinging, by the trainer, the boxing training device for the boxer to strike.

The contents of this summary section are provided only as a simplified introduction to the disclosure, and are not intended to be used to limit the scope of the appended claims.

BRIEF DESCRIPTION OF THE DRAWINGS

With reference to the following description, appended claims, and accompanying drawings:

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the present disclosure.

While the present disclosure discusses "boxing", "boxing training devices", "martial arts training", and/or "martial arts training devices" for purposes of convenience and illustration, one of skill in the art will appreciate that the methods, systems, and tools disclosed herein are broadly applicable, for example to various martial arts disciplines, fitness regimes, sports (e.g., football, soccer, volleyball, etc.) and/or the like.

For the sake of brevity, conventional techniques and devices for martial arts training, boxing training, physical fitness, and/or the like, may not be described in detail herein. Furthermore, the connecting lines shown in various figures contained herein are intended to represent exemplary functional relationships and/or physical or communicative couplings between various elements. It should be noted that many alternative or additional functional relationships or communicative connections may be present in a practical boxing training device.

Principles of the present disclosure may be utilized to address problems associated with current hand-held training devices. Typically, prior approaches utilize pads and/or mitts. Both lessen a blow arising from some type of martial arts training, sports training, athletic training, and/or the like, but still transfer some of the energy or force to the user of the pad or mitt. Boxing trainers, MMA trainers, and martial arts trainers are all aware of the impact this can have on the user of the pads and mitts.

The blows mentioned result in stress and wear to the trainer, and many experienced trainers report pain associated with the use of hand-held training devices. Some of these include pain reported in the neck, shoulders, elbows, and wrists. Other symptoms include joint strain and repetitive stress injuries in the arms and tendons. These injuries occur in professional and amateur trainers for boxing, martial arts, MMA, fitness, and sports.

Various shortcomings of prior martial arts training devices, for example boxing training devices, can be addressed by utilizing a boxing training device configured in accordance with principles of the present disclosure. Impact-related injuries to trainers may be reduced. Improved trainee fitness and martial arts skill may be achieved.

Figure 1:
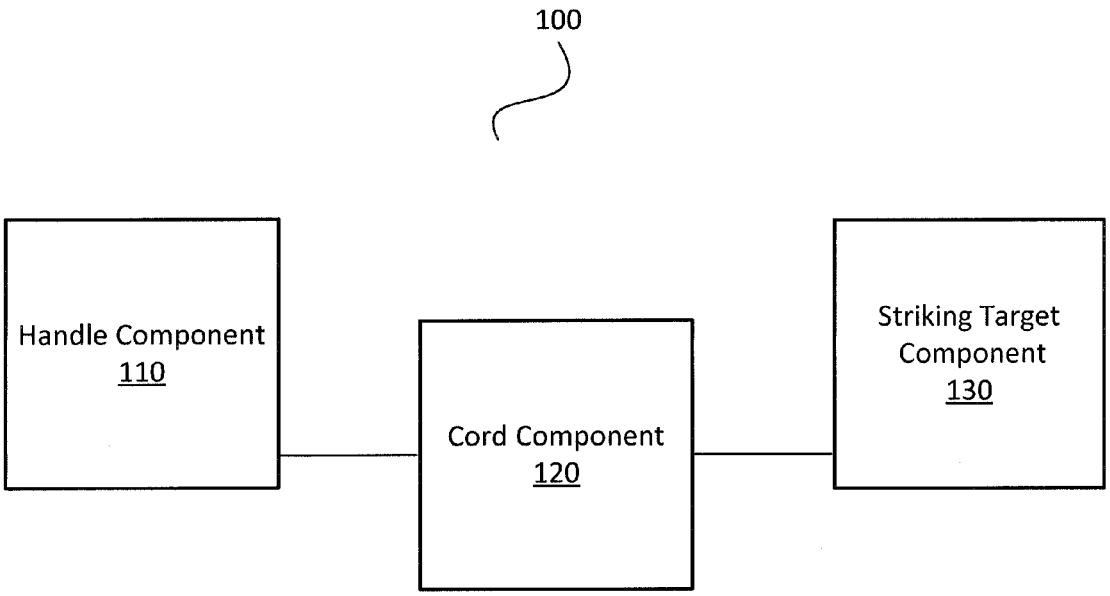
FIG. 1 illustrates a block diagram of components of an exemplary boxing training device in accordance with an exemplary embodiment.

With reference now to FIG. 1, in accordance with an exemplary embodiment, an exemplary boxing training device 100 generally comprises a handle component 110, a cord component 120, and a striking target component 130. Handle component 110 comprises one or more elements suitable for grasping by (or otherwise being coupled or linked to) a hand or arm. Cord component 120 is coupled to handle component 110 and links striking target component 130 thereto.

Cord component 120 may comprise suitable components and/or combinations thereof configured to flexibly couple structural component handle component 110 to striking target component 130. Moreover, although the term "cord" is used herein in reference to components of certain exemplary embodiments, it will be appreciated that principles of the present disclosure are applicable to systems and devices having various straps, chains, cables and/or the like, and thus references to a "cord", "loop", or similar are by way of illustration and not of limitation.

Striking target component 130 is coupled to handle component 110 via cord component 120. Striking target component 130 may comprise fabric, leather, padding, sand, inflatable bladders, and/or other bulk material and/or other suitable components and/or combinations thereof configured to provide a moveable target for striking or evading by a trainee.

Boxing training device 100 may be sized and/or weighted based at least in part on the age, size, strength, and/or skills of an intended trainee. Accordingly, a particular boxing training device 100 may be adapted to youth and/or casual use, while another boxing training device 100 may be adapted to heavyweight and/or professional use, and so forth.

Figure 2A:
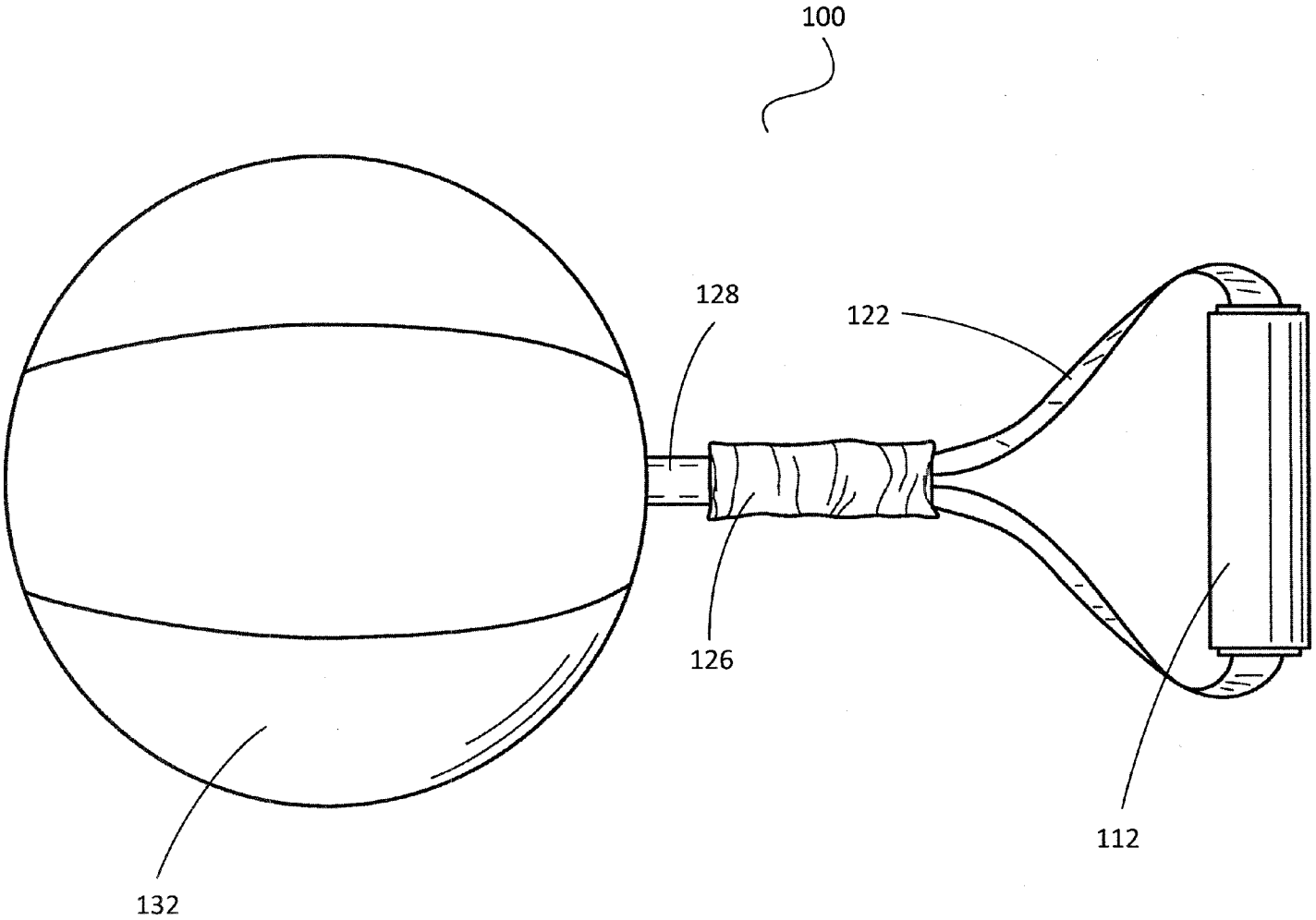
FIG. 2A illustrates an exemplary boxing training device in accordance with an exemplary embodiment.
Figure 2B:
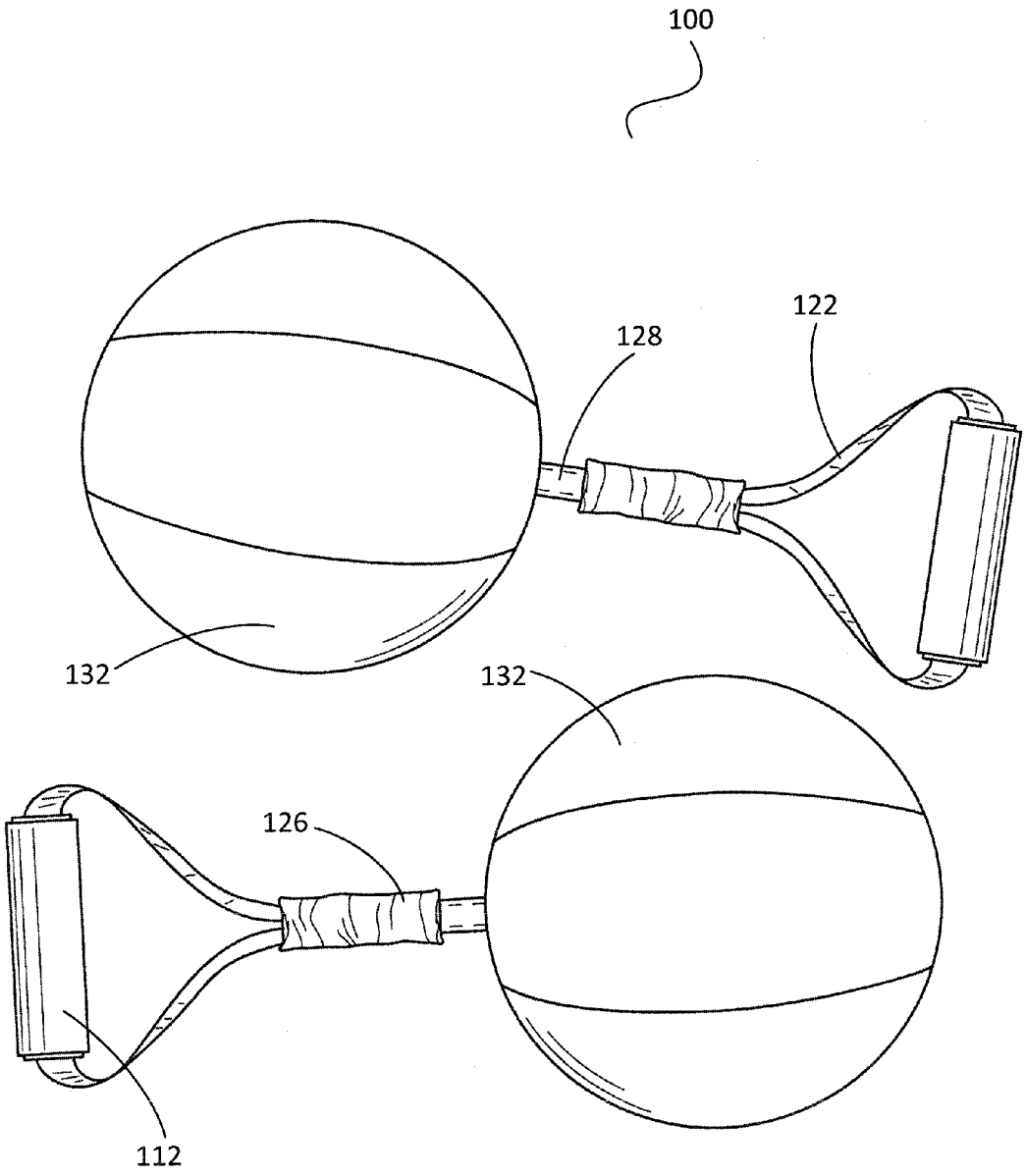
FIG. 2B illustrates a pair of exemplary boxing training devices in accordance with an exemplary embodiment.
Figure 2C:
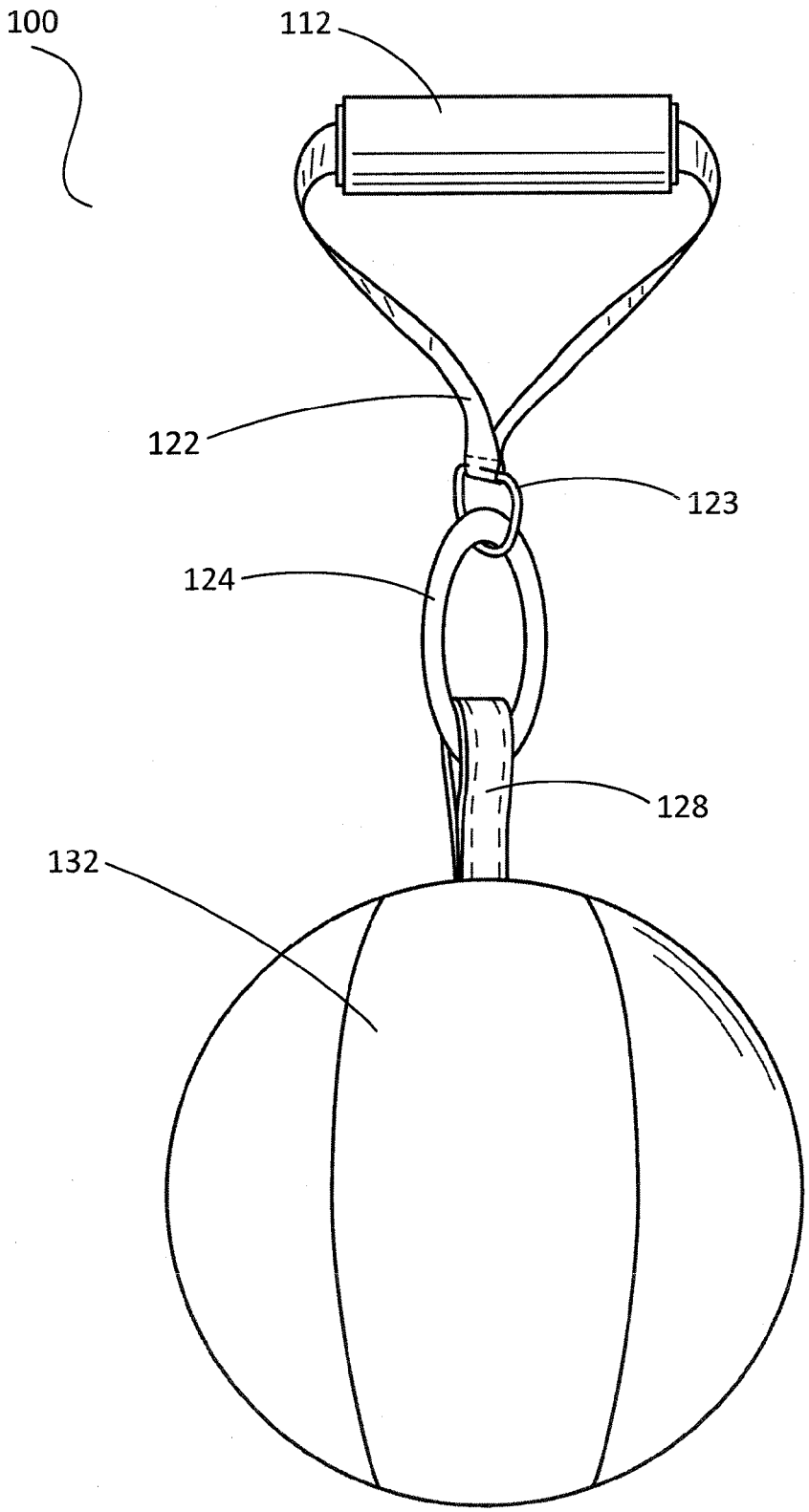
FIG. 2C illustrates components of an exemplary boxing training device in accordance with an exemplary embodiment.

In an exemplary embodiment, with reference now to FIGS. 2A through 2C, in various exemplary embodiments a boxing training device 100 comprises a handle 112, grasping cord 122, ring 123, bungee cord 124, sheath 126, target loop 128, and striking target 132.

Handle 112 is configured for grasping by a user, or otherwise coupling to a portion of a human body. In various exemplary embodiments, handle 112 comprises a hollow plastic tube. Handle 112 may be padded, for example for improved user comfort when grasping. In an exemplary embodiment, handle 112 is configured with a rigid portion holdable in a fist; handle 112 may also comprise a flexible portion laceable through the index and middle finger. In various exemplary embodiments, handle 112 may comprise protective rings for the fingers to enable control, a covering (e.g., foam, silicone, and/or the like) for the flexible portion to reduce chafing of the fingers, and/or custom hand wraps to reduce chafing.

Handle 112 may receive grasping cord 122 passed through the hollow portion of handle 112. Handle 112 may also be linked to grasping cord 112 in a "T-style" arrangement, whereby grasping cord 122 terminates approximately in the middle of handle 112. Moreover, handle 112 and grasping cord 122 may be coupled or linked in any suitable manner.

Figure 3A:
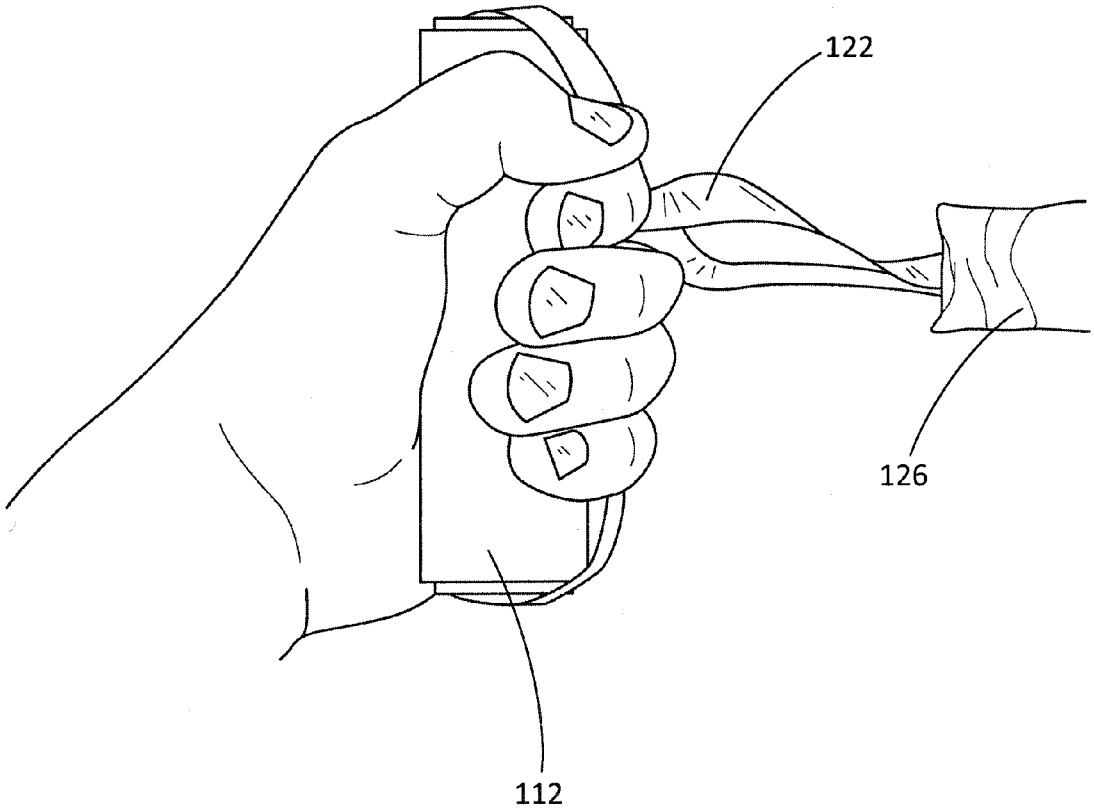
FIG. 3A illustrates a user grasping an exemplary boxing training device in accordance with an exemplary embodiment.

Grasping cord 122 couples handle 112 and ring 123. In an exemplary embodiment, grasping cord 122 comprises a nylon strap. Grasping cord 122 may comprise any suitable durable, flexible material, as desired. In various exemplary embodiments, grasping cord 122 is configured to be graspable together with handle 112, for example passing between the index finger and middle finger of a user as illustrated in FIG. 3A. Grasping cord 122 may be coupled to ring 123 in any suitable manner, for example via stitching.

Ring 123 couples grasping cord 122 and bungee cord 124. Ring 123 may comprise metal, for example stainless steel. Ring 123 may also comprise plastic or composite material. In various exemplary embodiments, ring 123 is circular. In other exemplary embodiments, ring 123 is D-shaped. Ring 123 may be sized and shaped in any suitable manner to link grasping cord 122 and bungee cord 124.

Bungee cord 124 is configured to provide flexibility, elasticity, and/or rebound to the overall link between handle 112 and striking target 132. Bungee cord 124 may comprise shock cord configured with a thickness of between about ⅛" and about ½". In various exemplary embodiments, bungee cord 124 comprises a loop having a loop diameter of between about one inch and about 4 inches, and preferably about 2 inches. In various exemplary embodiments, bungee cord 124 is configured as a loop linking target loop 128 and ring 123.

Target loop 128 is coupled to striking target 132 and provides a connection point for linking to handle 112. Target loop 128 may be integrally formed with striking target 132; alternatively, target loop 128 may be coupled to striking target 132, for example via stitching, rivets, fasteners, and/or the like. In various exemplary embodiments, target loop 128 comprises leather coupled to a reinforced region on striking target 132, for example via stitching. Target loop 128 may also comprise fabric, cordage, webbing, straps, and/or the like.

Sheath 126 is configured to at least partially cover one or more of grasping cord 122, ring 123, bungee cord 124, and/or target loop 128, for example as illustrated in FIGS. 2A and 2B. In various exemplary embodiments, sheath 126 comprises a flexible fabric, such as a fabric containing elastane or other stretchable material. In certain embodiments, sheath 126 is permanently affixed as part of boxing training device 100; in other exemplary embodiments, sheath 126 may be removable, for example via hook and loop fasteners or other suitable reversible fastening approaches.

It will be appreciated that in various exemplary embodiments, one or more of grasping cord 122, ring 123, bungee cord 124, sheath 126, and/or target loop 128 may be integrally formed with other components; stated another way, a single element may perform the function of multiple such components in certain embodiments.

With continued reference to FIGS. 2A through 2C, striking target 132 comprises a three-dimensional object suitable for use as a target to be struck (and/or evaded) by a trainee. Striking target 132 may be monolithic; striking target 132 may also comprise a durable outer layer (for example, leather, nylon, canvas, rubber, plastic, and/or the like) together with an inner layer (for example, foam, inflatable bladders of rubber or plastic, fiber batting, and/or the like). Striking target 132 may be coupled to target loop 128 via a hook, loop, fasteners, stitching, and/or the like; the portion of striking target 132 to which target loop 128 is coupled may comprise metal, rubber, leather, plastic, and/or any other suitably strong and/or durable material.

In various exemplary embodiments, striking target 132 may be spherical, pear-shaped, elliptical, oblong, and/or the like. Striking target 132 may be configured with any suitable weight, for example between about 8 ounces and about 4 pounds. Striking target 132 may have a diameter (and/or long axis length) of between about 4 inches and about 24 inches, and more particularly between about 6 inches and about 10 inches. Moreover, striking target 132 may be configured with any suitable size and/or weight, depending on the intended use, size of a trainer, size of a trainee, and so forth.

In various exemplary embodiments, boxing training device 100 is configured with a cord length (i.e., the overall distance between handle 112 and striking target 132) of between about 3 inches and about 12 inches, and preferably between about 8 inches and about 10 inches.

In various exemplary embodiments, boxing training device 100 may be coupled to and/or comprise a protective component for the trainer's hand. For example, boxing training device 100 may comprise or be coupled to a boxing glove; handle 112 may be disposed within the boxing glove such that a trainer may insert his hand into the boxing glove and grasp the handle therein. Moreover, boxing training device 100 may comprise or be coupled to a MMA glove; handle 112 may be coupled to and/or disposed at least partially within the MMA glove such that a trainer may insert his hand into the MMA glove and grasp handle 112 while wearing the MMA glove. Additionally, boxing training device 100 may comprise or be coupled to a training mitt; handle 112 may be coupled to and/or disposed at least partially within the training mitt such that a trainer may insert his hand into the training mitt and grasp handle 112 while wearing the training mitt.

Figure 3B:
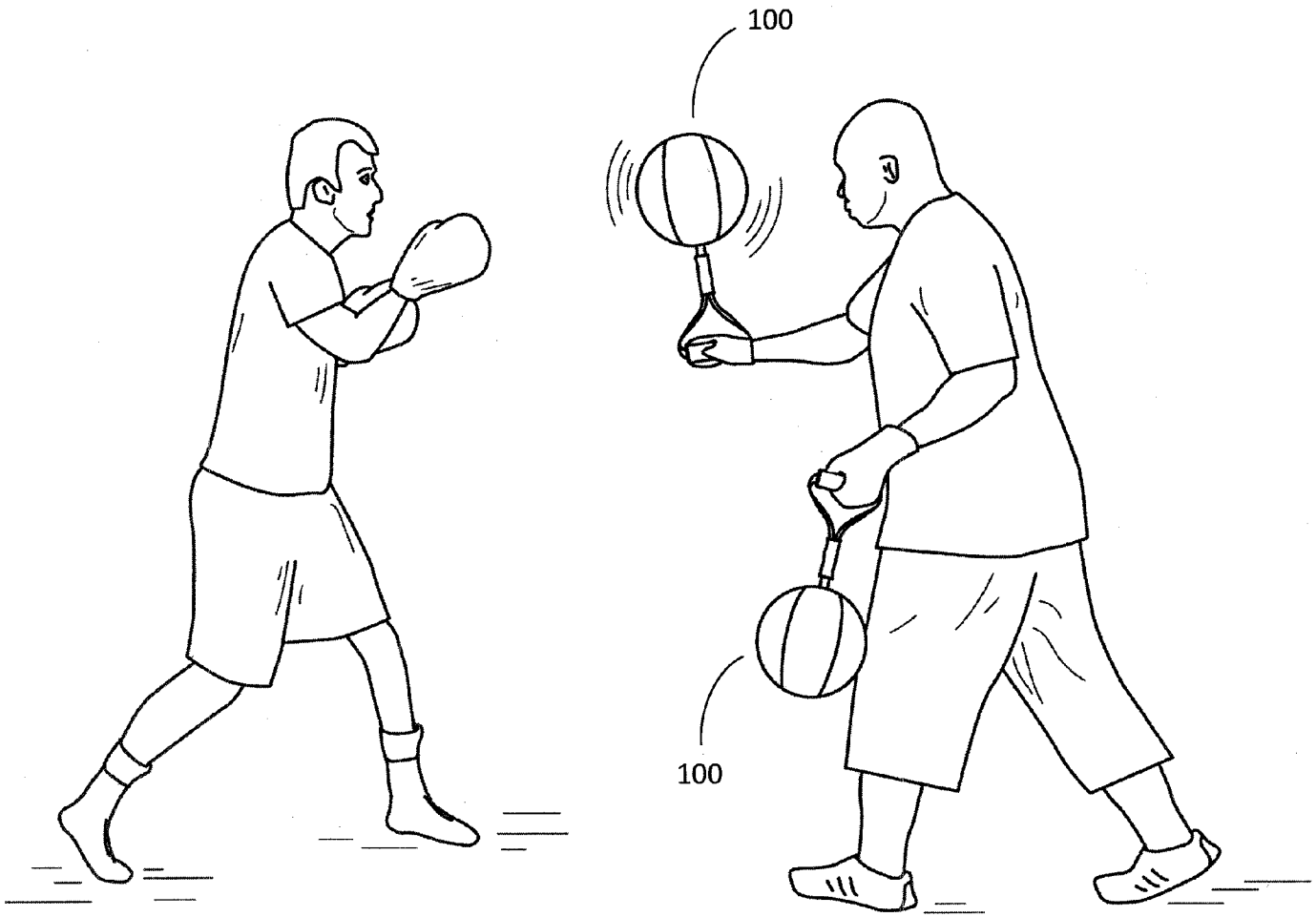
FIG. 3B illustrates use of an exemplary boxing training device in accordance with an exemplary embodiment.

Turning now to FIGS. 3A and 3B, in various exemplary embodiments a boxing training device 100 may be utilized as disclosed herein. In various exemplary embodiments, boxing training device 100 may be grasped by a user with grasping cord 122 passing between the index finger and the middle finger, for example as illustrated in FIG. 3A. Boxing training device 100 may also be grasped by a user at handle 112 without grasping cord 122 passing through the fingers.

In an exemplary embodiment, boxing training device 100 may be held by handle 112 and swung forward in a generally overhand motion while keeping the arm sufficiently extended to prevent striking target 132 from hitting the trainer after being struck by a trainee, for example as illustrated in FIG. 3B. Proper holding of handle 112 and motion of the arm allows striking target 132 of boxing training device 100 to be struck, absorb and deflect the blow, and return quickly for subsequent strikes without significant impact to the wielder of boxing training device 100. When used properly, boxing training device 100 can be used for training of straight jabs, punches, uppercuts, hooks, elbows, knees, kicks, blocks, ducks, and parry movements while maintaining distance, rhythm, and speed without any impactful blows to the wielder of boxing training device 100. In this manner, trainer health and stamina are preserved and debilitating injuries are reduced and/or eliminated.

It will be appreciated that boxing training device 100 may preferably be utilized as disclosed herein. If boxing training device 100 is not used in the manner specified, upon impact, striking target 132 may return and hit the trainer. This could include, but is not limited to a ricochet of striking target 132 to the face, head, arms, legs, torso, or groin. Improper use could also result in property damage to the surrounding area or a bystander. In accordance with principles of the present disclosure, in various exemplary embodiments boxing training device 100 is preferably used in a clear, level area, free from obstructions, bystanders, or other hazards. A user, for example a boxing trainer, may grasp handle 112 firmly and lace grasping cord 112 through the index and middle finger, for example as illustrated in FIG. 3A. It will be appreciated that the trainer may wish to use a cushion device or wrap the fingers used with standard hand wraps to prevent chafing. The trainer may preferably swing boxing training device 100 forward in a generally overhand motion while keeping the arm generally extended away from the body. Slight adjustments allow the trainer to aim boxing training device 100 to allow for a variety of strikes from a trainee. When striking target 132 is struck, the motion imparted to striking target 132 by the trainer is redirected by the trainee. Trainer arm angle and extension, together with the flexible linkage between handle 112 and striking target 132 (e.g., grasping cord 122, ring 123, bungee cord 124, sheath 126, and/or target loop 128) allow the trainer to control the resulting motion of striking target 132 away from the trainee. The trainer may redirect boxing training device 100 again for continued use in a similar manner without interruption.

In various exemplary embodiments, boxing training device 100 may be utilized in various ways to provide a striking target for a variety of punches or other martial arts moves. For example, in order to provide a striking target for an uppercut or upward kick, a trainer may swing boxing training device 100 in a generally overhand motion with the arm extended. In this manner, striking target component 130 moves in a downward manner suitable for striking with an uppercut or upward kick. In contrast, in order to provide a striking target for a hook, a trainer may swing boxing training device 100 such that striking target component 130 moves primarily in a lateral direction, suitable for use as a striking target for a hook coming in the opposite direction. Moreover, a trainer may utilize multiple boxing training devices 100 (for example, one on each hand) and may utilize the boxing training devices 100 to provide striking targets for a desired series of punches or other martial arts moves (for example, uppercut, hook, jab, cross, elbow punch, and so forth). It will be appreciated that while the manner in which boxing training device 100 is utilized will vary depending on the intended use, in general boxing training device 100 may desirably be utilized with the arm or arms generally extended in order to reduce and/or eliminate instances of striking target component 130 impacting the trainer responsive to a strike by the trainee.

In addition to offensive training as discussed above, in various exemplary embodiments boxing training device 100 may be utilized for defensive and/or evasion training, in addition to and/or in connection with striking training. For example, a trainer may swing boxing training device 100 laterally so that a trainee may duck thereunder. A trainer may also swing boxing training device 100 in a wide overhand arc so that a trainee may sidestep or lean out of the way. Moreover, a trainer may swing boxing training device 100 in a variety of ways to allow a trainee to repeatedly dodge, parry, evade, or otherwise implement one or more defensive movements.

It will be appreciated that it may be desirable, when boxing training device 100 is swung in a manner intended for defensive training, that the trainee not strike striking target 132 in an offensive manner in order to avoid ricochet or other impact to the trainer. However, combinations of defensive and offensive swings of a boxing training device 100 or multiple boxing training devices 100 are possible. For example, when a trainer is utilizing a boxing training device 100 in each hand, the trainer may swing the first boxing training device 100 in a manner intended for a defensive response (for example, a wide generally horizontal swing intended to be ducked under) and then swing the second boxing training device 100 in a manner intended for an offensive response (for example, in an overhand manner intended to provide a striking target for an uppercut). Similarly, a single boxing training device 100 may first be swung in a manner intended for a defensive response (for example, a parry) and then immediately thereafter swung in a manner intended for an offensive response (for example, a jab). Combinations and permutations of defensive and offensive uses may be interleaved, as desired, by the trainer to provide a realistic training regimen for a trainee.

Figure 4A:
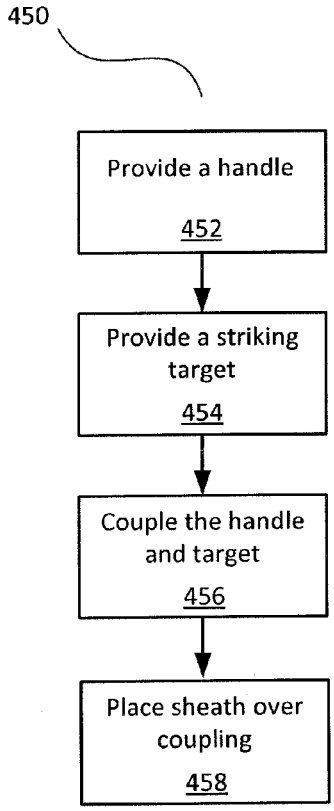
FIG. 4A illustrates a method for providing a boxing training device in accordance with an exemplary embodiment.

With reference now to FIG. 4A, in various exemplary embodiments a method 450 for providing a boxing training device comprises providing a handle (step 452), providing a striking target (step 454) and flexibly coupling the handle to the striking target (step 456). In method 450, the handle may be coupled to the striking target via a grasping cord, a ring, a bungee cord, and a target loop. Method 450 may further comprise disposing a sheath at least partially over one or more flexible coupling components (step 458).

Figure 4B:
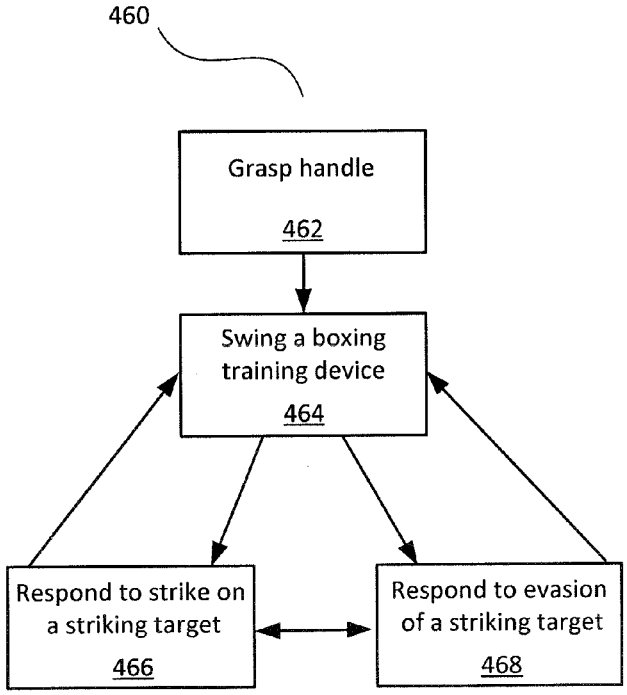
FIG. 4B illustrates a method for using a boxing training device in accordance with an exemplary embodiment.

With reference now to FIG. 4B, in various exemplary embodiments a method 460 for utilizing a boxing training device comprises grasping a handle (step 462). The handle is flexibly coupled to a striking target. Method 460 further comprises swinging the boxing training device toward a trainee (step 464); responding to a trainee strike on the striking target (step 466); and/or responding to trainee evasion of a striking target (step 468). In method 460, steps 464, 466, 468 and variations thereon may be repeated, combined, and or permutated, as desired, in order to provide a choreographed and/or free-form or adaptive training session for a trainee. In method 460, multiple boxing training devices may be utilized, for example one for each hand.

While the principles of this disclosure have been shown in various embodiments, many modifications of structure, arrangements, proportions, the elements, materials and components, used in practice, which are particularly adapted for a specific environment and operating requirements may be used without departing from the principles and scope of this disclosure. These and other changes or modifications are intended to be included within the scope of the present disclosure.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all embodiments.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, a functional connection, and/or any other connection.

In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. After reading the description, it will be apparent to one skilled in the relevant art(s) how to implement principles of the disclosure in alternative embodiments.

It should be understood that the detailed description and specific examples, indicating exemplary embodiments, are given for purposes of illustration only and not as limitations. Many changes and modifications may be made without departing from the spirit thereof, and principles of the present disclosure include all such modifications. Corresponding structures, materials, acts, and equivalents of all elements are intended to include any structure, material, or acts for performing the functions in combination with other elements. Reference to an element in the singular is not intended to mean "one and only one" unless explicitly so stated, but rather "one or more." Moreover, when a phrase similar to "at least one of A, B, or C" or "at least one of A, B, and C" is used in the claims or the specification, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A boxing training device for striking by a boxer's hand, the device comprising:

a hollow handle having a grasping cord passing as a loop through the hollow portion of the handle;

a ring configured to couple to the grasping cord;

a bungee cord loop configured to couple to the ring by passing through the ring;

a target loop configured to couple to the bungee cord loop by the bungee cord loop passing through the target loop;

a striking target coupled to the target loop and a sheath at least partially covering at least one of the grasping cord, the ring, the bungee cord loop, and the target loop.

2. The boxing training device of claim 1, wherein the striking target comprises an inflatable leather ball.

3. The boxing training device of claim 1, wherein the striking target is configured with a weight of between 8 ounces and 2 pounds.

4. A boxing training device for striking by a boxer's hand, the device comprising:

a hollow handle having a grasping cord passing as a loop through the hollow portion of the handle;

a ring configured to couple to the grasping cord;

a bungee cord loop configured to couple to the ring by passing through the ring, wherein the bungee cord loop has a loop diameter of between 1 inch and 4 inches;

a target loop configured to couple to the bungee cord loop by the bungee cord loop passing through the target loop; and a striking target coupled to the target loop.

5. The boxing training device of claim 4, wherein the striking target comprises an inflatable leather ball.

6. The boxing training device of claim 4, wherein the striking target is configured with a weight of between 8 ounces and 2 pounds.

7. A method of training a boxer, the method comprising:

grasping, in a fist of a trainer, a handle of a boxing training device; and swinging, by the trainer, the boxing training device for the boxer to strike, wherein the boxing training device comprises:

a hollow handle having a grasping cord passing as a loop through the hollow portion of the handle;

a ring configured to couple to the grasping cord;

a bungee cord loop configured to couple to the ring by passing through the ring;

a target loop configured to couple to the bungee cord loop by the bungee cord loop passing through the target loop; and a striking target coupled to the target loop.

8. The method of claim 7, wherein the bungee cord loop has a loop diameter of between 1 inch and 4 inches.

9. The method of claim 7, further comprising swinging, by a trainer, the boxing training device for the boxer to evade.

10. The method of claim 7, wherein the trainer grasps a first boxing training device in the fist of a first hand and a second boxing training device in the fist of a second hand.

11. The method of claim 7, wherein the swinging comprises an overhand motion with an arm of the trainer generally extended away from the trainer's body.

12. The method of claim 7, wherein the grasping cord is configured to pass between an index finger and middle finger of the trainer when the handle is grasped in the fist.

13. A method of training a boxer, the method comprising:

grasping, in a first fist of a trainer, a hollow handle of a first boxing training device;

grasping, in a second fist of a trainer, a hollow handle of a second boxing training device;

swinging, by the trainer, the first boxing training device for the boxer to at least one of strike or evade; and swinging, by the trainer, the second boxing training device for the boxer to at least one of strike or evade, wherein each boxing training device comprises:

a hollow handle having a grasping cord passing as a loop through the hollow portion of the handle;

a ring configured to couple to the grasping cord;

a bungee cord loop configured to couple to the ring by passing through the ring;

a target loop configured to couple to the bungee cord loop by the bungee cord loop passing through the target loop; and a striking target coupled to the target loop.

* * * * *